US005915561A

United States Patent [19]

Lorenzana et al.

[11] Patent Number: 5,915,561

[45] Date of Patent: Jun. 29, 1999

[54] LAP TRAY

[76] Inventors: Moises B. Lorenzana, 601 Lake Hinsdale Dr., Willowbrook, Ill. 60514; Vance A. Lorenzana, 73 Chippewa Dr., Osewego, Ill. 60543

[21] Appl. No.: 08/578,248

[22] Filed: Dec. 26, 1995

[51] Int. Cl.[6] ..... B65D 1/34

[52] U.S. Cl. ..... 206/562; 220/556; D7/701

[58] Field of Search ..... 206/562, 563, 206/564; 220/575, 556, 23.8, 17.1; D7/701, 707, 708, 553, 549, 555, 507; D6/406; 108/25, 42, 43, 46; 224/222, 267, 926

[56] References Cited

U.S. PATENT DOCUMENTS

| | | | |
|---|---|---|---|
| D. 186,368 | 10/1959 | Brown . | |
| D. 195,527 | 6/1963 | Gilbert | 206/563 |
| D. 246,945 | 1/1978 | Shore | D7/549 |
| D. 280,669 | 9/1985 | Hammeke | D7/553 |
| D. 293,163 | 12/1987 | Roth . | |
| D. 308,450 | 6/1990 | Harris et al. . | |
| D. 308,773 | 6/1990 | Morrow et al. . | |
| D. 314,678 | 2/1991 | Ali . | |
| D. 316,359 | 4/1991 | Anderson | D7/549 |
| D. 326,798 | 6/1992 | Grossman et al. . | |
| D. 363,643 | 10/1995 | Eisenberg | D6/406 |
| 1,885,483 | 11/1932 | Samuelson . | |
| 2,647,678 | 8/1953 | Olson . | |
| 2,652,702 | 9/1953 | Hintze | 220/23.8 |
| 3,244,125 | 4/1966 | Mackey | 108/25 |
| 3,804,233 | 4/1974 | Gregg, Jr. | 224/926 |
| 4,527,696 | 7/1985 | Harris et al. | 224/926 |
| 4,721,216 | 1/1988 | Kinder . | |
| 5,134,930 | 8/1992 | Mei-Hwa | 108/43 |
| 5,421,459 | 6/1995 | Mazzotti | 206/563 |
| 5,425,455 | 6/1995 | Miller et al. . | |
| 5,427,292 | 6/1995 | Rousch | 108/25 |

OTHER PUBLICATIONS

U. S. Patent No. D 326,962 to Mowry et al Jun. 1992.

*Primary Examiner*—Paul T. Sewell
*Assistant Examiner*—Nhan T. Lam
*Attorney, Agent, or Firm*—Neil M. Rose

[57] ABSTRACT

A lap tray having an elongated body portion to be supported across the upper legs of a seated person providing recessed areas for food and beverage containers and having downwardly extending vertical projections at the ends of the body portion to engage the outer thighs to retain the tray positioned.

6 Claims, 3 Drawing Sheets

LAP TRAY

FIELD OF THE INVENTION

The invention relates generally to lap trays and, more specifically, to trays usable by a seated person in any situation in which food and beverage are being consumed. The lap tray is particularly useful for the driver and the passengers of a motor vehicle to support food, beverage containers and related utensils in a convenient location.

BACKGROUND OF THE INVENTION

There are many types of food serving trays that have been designed for individual use by a seated person. Whenever someone is eating a snack or a full meal away from the conventional dining table, it is generally preferred to utilize an individual serving tray in order to make it possible to hold and partake of a number of food and beverage items. The need for such individual serving trays arises more frequently today with the more informal living styles and the tendency to eat while watching television in a family room or recreation room. In the absence of large formal dining rooms, dinners are often served buffet style with individual serving trays or tables being provided for the food and beverages while they are being consumed. Such individual food and beverage serving trays are also used at picnics, beach parties, camp-outs and any other outdoor excursion where food and beverages might be consumed.

The most commonly used of these serving trays consists of little more than a small flat tray with a shallow rim around the periphery. The tray must be balanced in the lap with a main requirement that it be maintained level so that the beverage container will not slide to the edge of the tray and spill as it strikes the rim. Accordingly major problems with most prior serving trays are the failure to provide means to stabilize the tray on the users lap and the absence of means to hold the food and beverage items in place on the tray. While there are some serving trays that have compartments to separate various foods and have shallow depressions for coffee cups, for instance, there seem to be no serving trays that solve the problems of maintaining the serving tray securely positioned in the lap and also maintain the food and beverage items positioned against sliding on the tray.

There are many examples in the prior art of individual trays used in serving food and beverage to consumers at buffet meals, cocktail parties and the like. These trays are intended to support food or beverage items or both while at the same time allowing the user to have one or both hands free to handle the particular item being consumed. Many of these are lap trays which are placed on the legs or lap of a seated person leaving both hands free to consume the contents of the tray. Examples of United States patents showing such lap trays are Harris et al U.S. Pat. No. Des. 308,450, Morrow et al U.S. Pat. No. Des. 308,773, Ali U.S. Pat. No. Des. 314,678, Grossman et al U.S. Pat. No. Des. 326,798, Mowry et al U.S. Pat. No. Des. 326,962, Samuelson U.S. Pat. No. 1,885,483, Olson U.S. Pat. No. 2,647,678 and Miller et al U.S. Pat. No. 5,425,455. None of these patents disclose lap trays that solve the problems discussed above with respect to retaining the tray on the lap.

In any discussion of individual food serving trays, consideration should be given to special circumstances that may place further restrictions on the type of serving tray that would be usable. In this day of well designed and constructed roads and automobiles, it is very common for drivers and passengers in such automobiles to be consuming food and drink while the automobile is being driven.

However, the distraction of the driver's attention from driving during the actual consumption of food and drink may present risks to the safety of the automobile and its passengers. The risk may also be present during periods in which the driver is juggling the items of food or beverage while at the same time guiding the vehicle. It has been accepted that optimum control of a motor vehicle is achieved when the driver has both hands gripping the steering wheel. Accordingly, it is desirable to minimize the periods of time that the driver takes one hand off of the steering wheel to hold food or beverage items or to transport such items to the vicinity of his mouth for the purpose of eating or drinking.

The first and most obvious way of reducing this time in which the driver has only one hand on the steering wheel is to provide adequate means for temporary storage of such food and beverage items in immediate proximity to the driver. It must be understood that the most common beverage item consumed by the driver whether simply commuting to work or driving across country is hot coffee. Even more so than other beverages consumed in the automobile, hot coffee presents a serious risk of burning the driver as well as damaging the interior of the vehicle if a spill were to occur. However, there are many beverages other than coffee that are contained in different types of cans, boxes, cups etc. which are consumed by people driving automobiles. Because of the basic instability of the vehicle as a support for any open beverage container, it is desirable to provide some means of holding the container upright if the driver is to be able to store the container temporarily without holding on to it. In the design of some of the more sophisticated automobiles the need for some sort of beverage container holder has been recognized, and there have been provided cup or container receiving wells located along the vehicle dash board or in the area between the driver's and the passenger's seats. These cup receiving wells are often not disposed immediately adjacent the driver and are often difficult to access particularly by a left handed person.

In addition to the cup receiving recesses, some vehicles are provided with shelves on the dash board or in the console between the front seats. These shelves may be used to store food items such as hamburgers, French fries and other typical "carry out" types of food as well as the plastic utensils that might be provided to eat such foods. In general these shelves are poorly positioned with respect to the driver so that his attention will be distracted from the road as he accesses these shelves for the food and related items stored thereon. In addition to the shelves and receptacle holders that are supplied as original equipment with some automobiles, there have been many types of shelves and receptacles sold through automotive parts stores and hardware stores for installation by the car owner in an attempt to solve the problem of temporarily storing beverage cups and fast food so that is conveniently accessible to the driver. None of these items has solved the problem of storing such food and beverage items in convenient proximity to the driver so as to minimize the distraction of the driver as he selects such food and beverage items and returns them to the temporary storage means.

The individual serving trays, that are designed for use around the home for buffet dining and the like as well as those designed for use at picnics and family outings, are not at all suitable for use in an automobile. The main problem involved in the use of such serving trays by the driver of an automobile relates to the difficulty of maintaining the lap tray in position while at the same time performing the driving function and having the automobile subjected to the normal forces as it stops, starts and passes through turns. Lap trays that were intended to be balanced on the legs of the user would not be suitable for a driver who should be concentrating on his driving and not on maintaining the position of a lap tray and its contents. Furthermore, the lack of adequate means to secure the food and beverage containers from sliding or shifting on the tray surface would also make them unsuitable for use in a moving vehicle.

Although the space between the steering wheel and the trunk or torso of the driver may be controlled by the positioning of the seat, the preferred position places the driver's torso about 6 to 10 inches away from the edge of the steering wheel. As a consequence, most individual serving trays would not comfortably fit in the space between the driver's torso and the steering wheel. This problem may be further aggravated by the fact that many drivers have a protruding stomach that lessens the space available between the steering wheel and the driver's torso to accommodate any sort of lap tray.

It would also be desirable for the lap tray to be sufficiently narrow so that it could be inserted into and removed from the driver's lap while he is seated behind the steering wheel. It would be inconvenient and possibly hazardous if the tray extended beneath the steering wheel and removal of the tray required the driver to move from his seat behind the wheel. There would also be a possible problem with the tray or its contents interfering with the rotation of the wheel if it extended beneath the wheel when in position in the drivers lap.

There are other prior art patents that relate generally to food and beverage serving trays which fail to solve the problem of securing the tray with respect to the user's lap. The Mackey U.S. Pat. No. 3,244,125 is directed to a food serving tray which is intended to rest on the seat of an automobile. The tray of the Mackey patent is not a lap tray, and it would be inconvenient and distracting for the driver to be required to turn to the side and reach across toward the middle of the seat to take from and return items to this tray. The British Patent Specification No. 1,121,150 discloses a lap tray which is adapted for supporting a book or writing materials as well for food and beverages. While the British patent discloses various embodiments of lap trays that have pockets for receiving food and beverage containers, no means are disclosed for securing the trays in place in the lap. The trays of the British patent provide a substantial angle between the food supporting surface and the leg engaging portions of the lap trays. Other patents on food and beverage serving trays designed for use in an automotive are the Brown U.S. Pat. No. Des. 186,368 and Roth U.S. Pat. No. Des. 293,163 neither of which would be suitable for use as a lap tray.

The U.S. Pat. No. 4,721,216 to Kinder is directed to a beverage container holder which is intended to be supported on the seat of a car between the legs of the user. The holder has an upwardly facing recess which is stepped downwardly in diameter in order that the holder would receive and support beverage receptacles of differing sizes and shapes. Other than this recess configuration, the Kinder patent has no relevance to the lap tray constituting our invention.

SUMMARY OF THE INVENTION

The present invention is directed to a lap tray intended for use by a seated person in providing or serving foods and beverages. It is useful as a lap tray for food and beverage service for buffet meals, for picnics, to serve people in automobiles, in bed, in wheel chairs or in any situation where someone is consuming food and beverages away from a table and has need for a well supported lap tray. The tray includes an elongated body portion which is formed at the opposite ends with depending pocket defining portions, the pockets being of a suitable dimension to receive beverage containers, food or eating utensils. The pocket defining portions form downward extensions which are slightly tapered and extend downwardly a sufficient distance to engage the widest portions of the upper legs or thighs of the seated person. As engaged with the outside of the person's upper legs, the tray is stabilized against movement. The inner faces of the pocket defining portions are spaced about 14 inches apart so as to straddle the legs of the person, and these inner faces are textured or roughened to assure that the tray will be held in place by the engagement with the legs as described.

There is a natural tendency for a person's legs to splay or spread apart at the knees as he sits down and assumes a comfortable posture. It is this natural spreading of the upper legs that is taken advantage of in holding the lap tray of the present invention in place in the lap of the user. The thighs have a natural tendency to engage against the pocket defining portions of the tray each of which extend downwardly sufficiently and present a substantially vertical wall engaging the outer thighs so that there is no tendency for the pocket defining portions to ride up on the legs in response to this pressure by the thighs. As a consequence, the lap tray is essentially locked in position by the natural pressure exerted by the legs The body portion of the tray is formed with two shallow recesses spaced on either side of a central well. Each of the shallow recesses is somewhat trapezoidal in shape with a flat bottom wall and a surrounding rim to prevent food items such as sandwiches, hamburgers or the like from sliding off of the tray. The central well is of a lesser depth than the pockets disposed at the ends of the body portion and is designed to receive among other things, beverage receptacles that are too small to be easily retrieved from one of the pockets. With the pockets being about 4 inches deep, a person would have difficulty grasping a 3 inch or 3½ inch high receptacle which would not project above the mouth of the pocket. The central well is less than 3 inches deep and has a stepped interior configuration so as to accommodate beverage containers of different size and shape.

The body portion of the tray is narrow in width so as to be easily accommodated in the lap of the user and is compact for easy storage when not in use. The narrow width of the lap tray also adapts it for use in situations where space might be at a premium as, for instance, in an automobile and particularly for a driver whose available lap space is restricted by the steering wheel. At the outer ends, the body portion is on the order of 7 inches wide with the edges interconnecting these wide end portions being slightly concave so that the width of the body portion at the center adjacent the central well is on the order of 5 inches. This concave configuration of the edges of the body portion permits the tray to be comfortably accommodated in the lap of somewhat obese persons.

The narrow width of the tray and the concave configuration of the front and back edges of the tray permit the tray to be inserted into the lap of a driver while he is positioned behind the steering wheel. Since it would be very difficult for a driver to insert himself behind the wheel while the lap tray is in place in his lap, it is important that the tray be of such a shape that it may be placed in the lap after the driver is behind the steering wheel. Likewise, it is important that the tray be easy to remove from the lap when the tray has served its purpose and the food and beverage contained on the tray has been consumed. Again, the narrow width and the concave edges permit the tray to be removed easily from the lap without interfering with the operation of the steering wheel.

The pockets at the opposite ends of the body portion are of the same depth so as to perform the tray retention and stabilizing function but are otherwise quite different. One is of generally cylindrical configuration being about 3 and ½ inches in diameter at the mouth with a 5 degree inward taper toward the bottom. As so configured, it will accommodate the conventional large 16 ounce beverage containers and many other odd shaped containers including the rectangular juice boxes. At the other end of the body portion of the tray, there is a somewhat oval shaped recess as viewed from above with the pocket or recess being about 4 inches deep with the walls tapering inwardly at about 5 degrees. The oval shape of the recess adapts it to receive various shaped packets of food or beverage or possibly eating utensils and napkins.

With the body portion of the tray being symmetrical about its lengthwise extending center line with the same concave configuration on both edges, the tray may be placed in the lap in either of two positions to situate the pockets in the most convenient arrangement for either left or right handed person. Thus a left handed person drinking from a 16 ounce beverage container would position the tray with the large cylindrical pocket to his left while a right handed person with the same drink container would want the tray reversed. By this arrangement a person may position the food and beverage items in the most convenient location so that there is a minimum of distraction or inconvenience in taking items from or returning items to the tray. This arrangement is particularly advantageous for the driver of an automobile since the items of food and beverage may be positioned as close as possible to the steering wheel while at the same time not representing an obstruction to the driver's operation of the vehicle.

The lap tray of the present invention is preferably a single molded piece of high impact plastic material and is, as a consequence, inexpensive to produce. The channel shaped rim portions surrounding the pockets, the shallow recesses and the central well provide structural rigidity to the tray. The trays are easily nested or stacked for storage so that 10 or 12 trays could be stored in a very compact space.

Accordingly, it is an object of the present invention to provide an improved individual lap tray for the serving of food and beverage items including means for retaining the tray in position on the lap.

It is a further object of the present invention to provide an improved lap tray which is compact and which has means projecting from the tray for engagement with the outer thigh surfaces to retain the tray in position in the lap.

It is a further object of the present invention to provide an improved automobile lap tray which has a narrow front to back dimension so as to fit easily between a driver and the steering wheel and has downward extensions at the outer ends to stabilize the tray through engagement with the outside of the upper legs of the driver.

It is another object of the present invention to provide an improved lap tray which is elongated with food receiving pockets disposed along its length and which is symmetrical about a lengthwise extending center line so that the tray may be positioned in two alternative positions to accommodate the convenience of the user.

Additional objects and advantages of the invention will become apparent as the following detailed description of the preferred embodiment is read in conjunction with the accompanying drawings which illustrate such preferred embodiment.

DESCRIPTION OF THE PREFERRED EMBODIMENT

Figure 1:
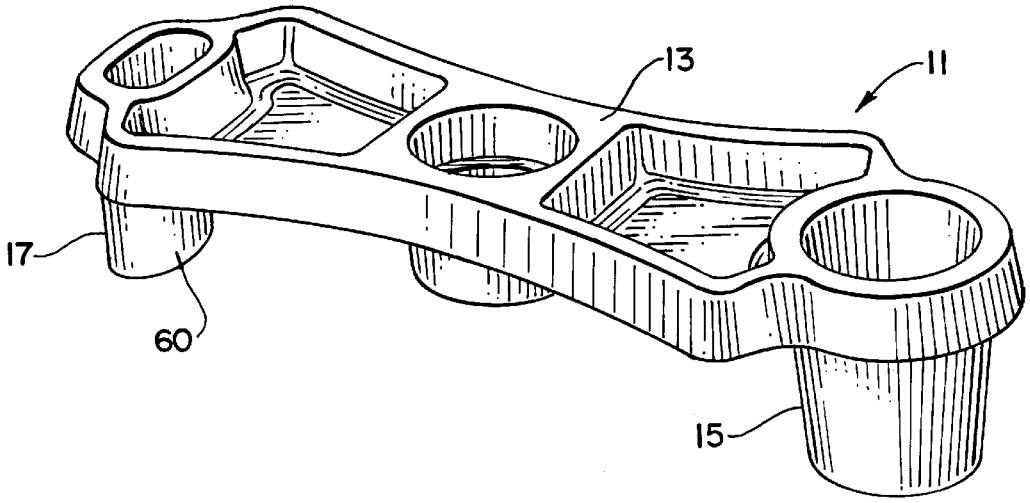
FIG. 1 is a perspective view of a lap tray embodying the present invention.

Referring to the drawings, the lap tray of the present invention is designated generally by reference numeral 11 and it is designed for use by a seated person when consuming food and beverages. It should be understood that the tray 11 has broad applications and use in any situation where a seated person is consuming food or beverages and has no table or the like from which to eat or on which to place the food and drink while it is being consumed. Thus the tray of the present invention would be suitable for use by the passengers in a car as well as the driver. In addition, it would also be very suitable for use in serving buffet meals, at picnics, snacking while watching television, eating while siting in a wheel chair or in bed or any other situation where a person might be trying to balance a plate of food and a beverage glass on the lap or on a conventional serving tray.

As utilized in the automobile, the usual source of food would be fast food or convenience food restaurants or the like. Accordingly, in FIG. 2 the tray 11 is shown as it might be supplied with various types of so called "fast food" and beverages. The versatility of the tray 11 and the manner in which it accommodates specific types of food and beverage items will be discussed along with a description of the structure of the tray 11.

The tray 11 includes a body portion 13 which is elongated and supports at its outer ends a pair of downwardly extending projections 15 and 17. The projections 15 and 17 serve two separate and distinct functions. First they are shaped differently to receive and support different types of food and beverage items. Secondly, the tray 11 is designed to lie crosswise on the thighs of a seated person with the outer ends projecting beyond the outer edges of the thighs of the seated person. The downward projections 15 and 17 are to be disposed against the outside of the thighs to retain the tray 11 in position in the lap of the seated person.

To understand the manner in which the tray is held in position on the lap, it is necessary to consider the posture or position a person naturally assumes in the siting position. There is a tendency for the legs to splay or separate at the knees causing the thighs to move outwardly. As a consequence, the outer thighs have a natural tendency to engage the projections thereby holding the tray 11 in position in the lap. With the legs spread slightly at the knees, the feet and lower legs may still be moved while maintaining contact with the thighs against the projections 15 and 17.

The projection 15 is formed with inwardly tapering sidewalls 19 which terminate in a generally horizontal bottom wall 21 and a lip 23 defining the top opening to a pocket or cavity 25. The pocket 25 is of a size to receive and support the large 16 ounce containers commonly used by gasoline stations that sell coffee and in fast food or carry out restaurants. The pocket 25 is about 4 inches deep with a diameter at the lip 23 of 3½ inches with the walls 19 tapering inwardly at a 5 degree angle toward the bottom 21. The pocket 25 is of a size to receive the standard 12 ounce soft drink cans as well as the 16 and 20 ounce bottles.

Figure 3:
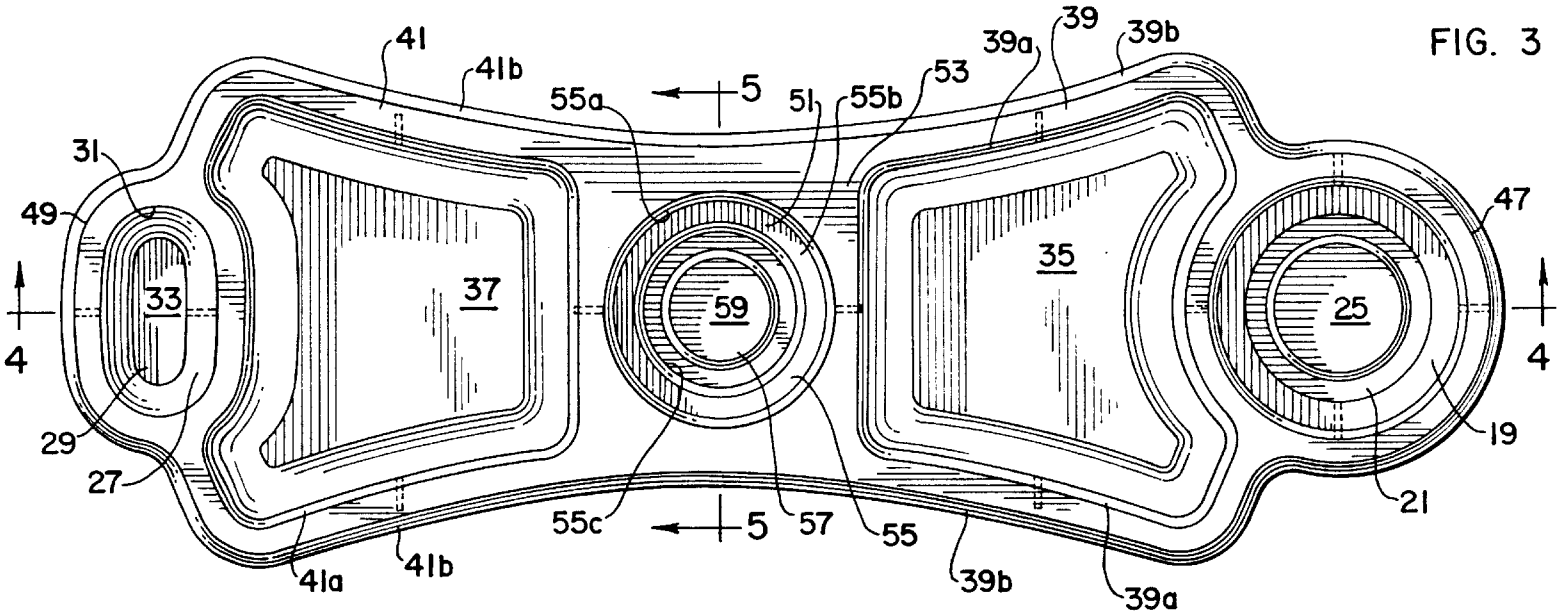
FIG. 3 is a top plan view of the lap tray of FIG. 1.

The downward projection 17 includes sidewalls 27 tapering to a bottom wall 29 and having a lip 31 defining a top opening to a pocket 33. As best shown in FIG. 3, the pocket 33 differs in shape from the pocket 25 in that it has a horizontal section which is generally oval in shape rather that circular. The inclusion of the cylindrical pocket 15 along with the oval pocket 33 provides the means to receive and support a variety of different types and shapes of food and beverage receptacles from the conventional tapered cups to the square and rectangular milk and juice cartons and plastic squeeze bottles and the most common soft drink cans and bottles.

Figure 2:
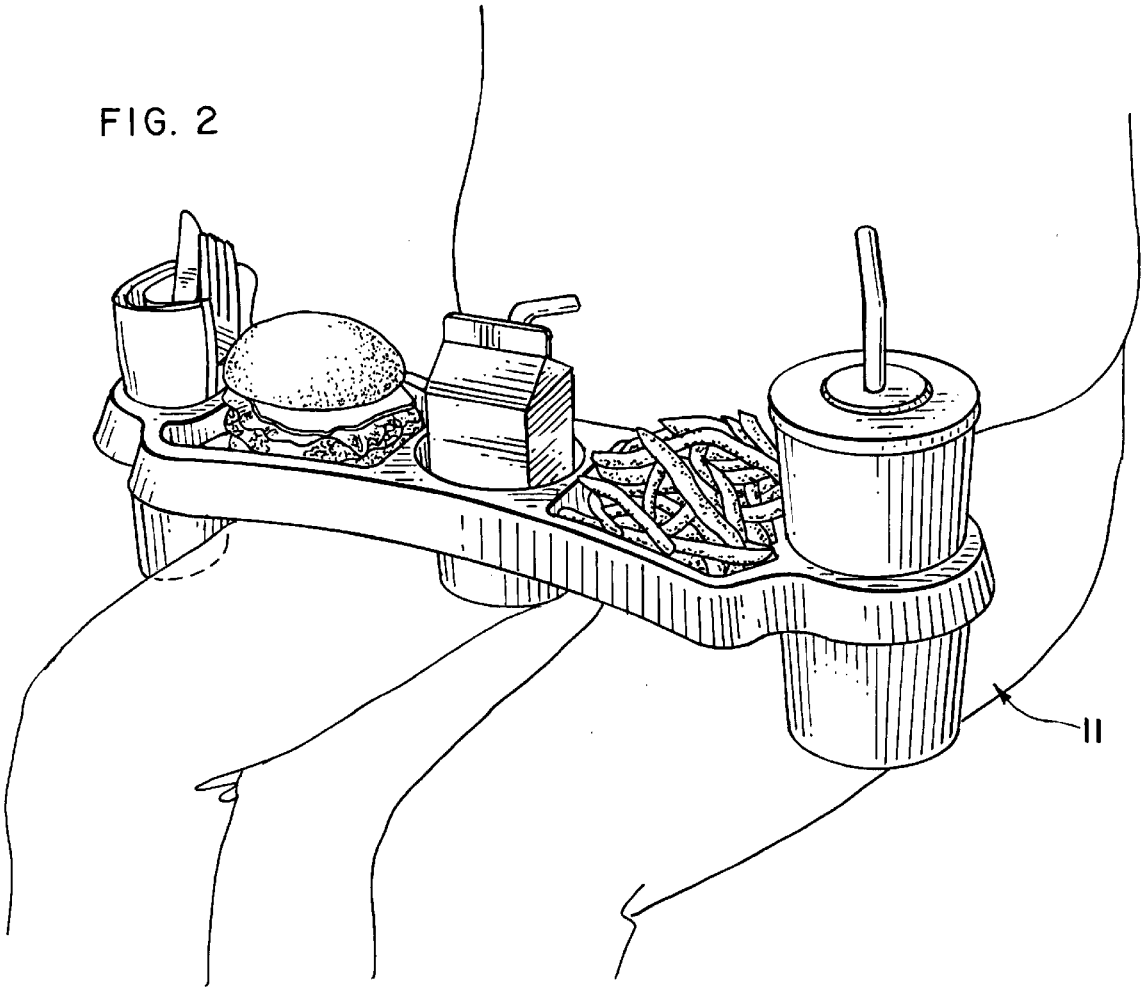
FIG. 2 is a perspective view of the lap tray of FIG. 1 shown in position in the lap of a user with food and beverage items positioned thereon for illustrative purposes.

The body portion 13 of the tray 11 includes two flat members 35 and 37 which are spaced from each other along the length of the body portion and which are somewhat trapezoidal in shape. These members 35 and 37 function to support the tray by engaging the upper face of the thighs of a seated person using the tray. Surrounding each of the members 35 and 37 are peripheral rims 39 and 41 respectively which extend upwardly from the plane of the members 35 and 37 to define a pair of shallow recesses 43 and 45 which are designed to receive various items of food such as a hamburger or French fried potatoes as shown in FIG. 2. The rims 39 and 41 include inner walls 39*a* and 41*a* which extend upwardly from the members 35 and 37 and also include downwardly extending walls 39*b* and 41*b* on the outer edges of the body member 13. The rims 39 and 41 and particularly the inner walls 39*a* and 41*a* serve to retain the food items on the tray 11 and contribute rigidity to the tray 11. In addition to the rims that extend around the members 35 and 37 to define the shallow recesses 43 and 45, there are rims 47 and 49 extending around the outer portions of the pockets 25 and 33. The rims 47 and 49 are joined to the walls 39*b* and 41*b* of the rims 39 and 41 to form a continuous peripheral wall around the outer edges of the tray 11 to provide the desired rigidity while using relatively thin sections in the molded plastic for the tray 11. It should be noted that the walls 39*b* and 41*b* and the rims 47 and 49 form part of inverted channels or downwardly facing channels with the inner walls 39*a* and 41*a* and projections 15 and 17. These channels are very resistant to flexure in a direction transverse to the depth of the channel and accordingly provide rigidity for the tray 11.

Located in the midpoint of the body portion 13 is a central well 51 which is disposed in a plateau portion 53 interconnecting the portions defining the shallow recesses 43 and 45. The downwardly extending edge walls 39*b* and 41*b* of the rims 39 and 41 extend in toward the transversely extending centerline of the body portion 13 meeting adjacent to the well 51. The central well 51 forms a cup shaped recess opening upwardly and having a generally cylindrical sidewall 55 which includes an upper inwardly tapered portion 55*a* which is separated by an annular shoulder 55*b* from a lower tapered sidewall 55*c*. The sidewall 55*c* terminates at a bottom wall 57 which with the sidewall 55 defines an upwardly facing cup shaped recess 59. The recess 59 is on the order of 3 inches deep while the outer pockets 25 and 33 are on the order of 4 inches deep. Many of the small size coffee or beverage containers in common use are between 3 and ½ and 4 inches tall. Accordingly, if the small container were to be placed in the pocket 25, there would be considerable difficulty in removing it from the pocket since the top of the container would be below the lip 23. The more shallow central well 51 solves this problem when dealing with containers having a small vertical height. The central well 51 is also useful to receive the small square milk cartons as shown in FIG. 2. This type of carton rests on the shoulder 55*b* providing adequate support and making removal of the carton easy for the user.

As mentioned above, the downward projections 15 and 17 serve to engage the outermost portions of the thighs to hold the tray 11 firmly in position in the lap of the seated person. For the projections to accomplish this function properly, the projections 15 and 17 must extend downwardly to engage the outermost portions of the thighs which has been determined to be a distance of 3 inches to 3 and ½ inches below the thigh engaging members 35 and 37. Any shorter projection runs the risk of the projection engaging the angled upper portion of the thigh which would cause the tray 11 to ride up as the legs pressed outwardly against the projections.

Figure 6:
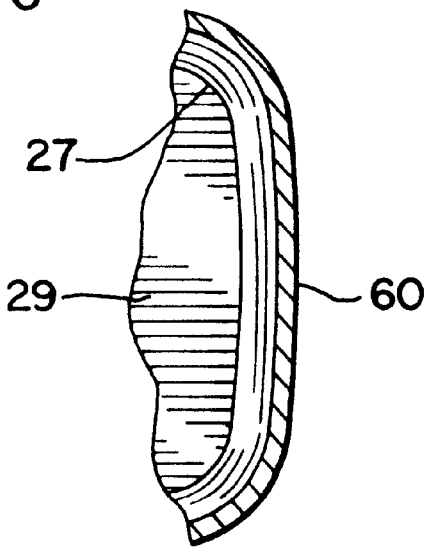
FIG. 6 is a fragmentary sectional view taken on line 6—6 of FIG. 4.

To assure slide resistant engagement between the projections 15 and 17 and the outer surfaces of the thighs, the inwardly facing portions of the walls 19 and 27 are roughened at 60 as shown best in the sectional view of FIG. 6. The roughened areas 60 in the inwardly facing surfaces of the walls of both projections 15 and 17 may comprise striations molded into those wall areas or slip resistant material applied to the walls 19 and 27.

In describing the lap tray 11, reference has been made above to the lengthwise centerline and the transverse centerline. While apparent from the description, the lengthwise centerline is coincident with the section line 4—4 and the transverse centerline is coincident with the section line 5—5.

Although it is obvious that it would be impossible to provide a single size lap tray of the present invention which would be usable by people of every size and shape, it has been found that a standard size will be suitable for the majority of adults. It may be necessary to provide large and small sizes to satisfy to entire population. The dimensions of the lap tray which fits the majority includes a spacing of about 14 inches between the downward projections 15 and 17. The optimum spacing for a tray suitable for the majority of the population would be in a range of between 13 inches and 15 inches. It is recognized that a small size tray might be of interest having a projection spacing of on the order of 12 inches and a large size having a projection spacing of on the order of 17 inches.

The distance that the projections 15 and 17 extend below the flat members 35 and 37 in the preferred embodiment is on the order of 3 inches. The 3 inch extent of the projections is sufficient in most cases to extend far enough down the sides of the thighs to prevent the tray from riding upwardly as a consequence of the outward pressure of the thighs. If the projections are longer than the thickness of the thighs on the seat, the tray will have an undesirable lack of stability since it would no longer be resting on the thighs. It should be understood that if a smaller size tray were supplied to accommodate to smaller legs, the length of the projections 15 and 17 would be reduced slightly so that they would still accomplish the above described functions. Likewise, the projections 15 and 17 would be lengthened to extend further downwardly in the case of a large size tray to engage the widest portions of the thicker thighs.

Figure 4:
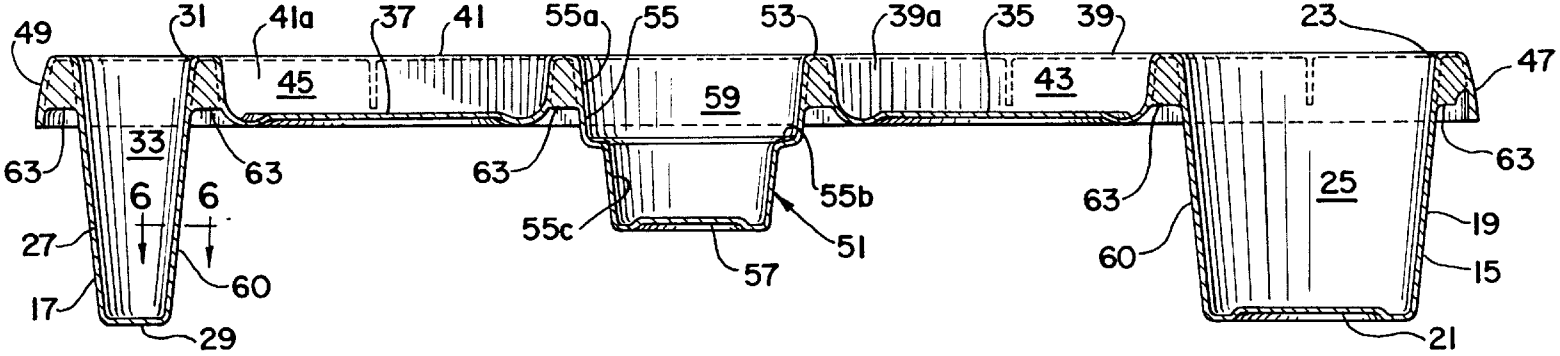
FIG. 4 is a sectional view taken on line 4—4 of FIG. 3.
Figure 5:
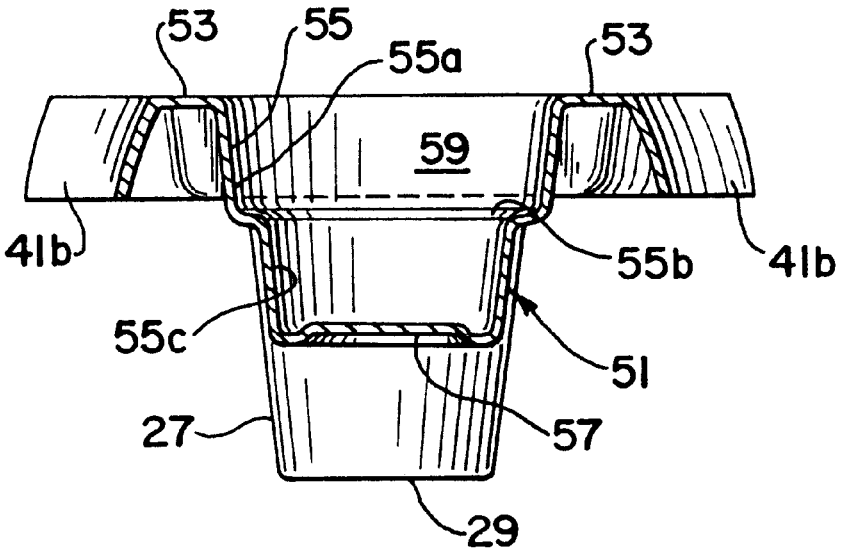
FIG. 5 is a sectional view taken on line 5—5 of FIG. 3.

The molded tray 11 is designed so that multiple trays may be stacked or nested together for compact storage. The draft angles of 5 degrees for the walls of the pockets 25 and 33 prevent the stacked trays from becoming jammed together so that they would be difficult to separate. This angle may be increased to as much as 10 degrees while still achieving acceptable results. To prevent jamming or locking together of nested trays in the area of the rims 39, 41, 47 and 49 there are provided web portions 63 which extend across the inverted channels as shown in FIG. 4.

From the foregoing detailed description, the versatility and the functional advantages of the lap tray 11 should be evident. By taking advantage of the natural tendency of a seated person to spread the legs slightly in assuming a comfortable sitting position, the invention provides means for holding an individual lap tray in a fixed position in the lap of the user. The natural engagement of the outer thigh surfaces with the downward projections on both ends of the body portion of the tray located the tray against accidental displacement. The substantially vertical disposition of the inner walls of the projections assures that the engagement between the outer thighs and the projections will not destabilize the tray by causing it to ride up over the thighs. The natural and relaxed position of the legs in retaining the tray in position results in the legs being slightly spread at the knees. With the legs so positioned, the feet and lower legs may be shifted without disengaging the thighs from the projections 15 and 17. Accordingly, when the tray is used by the driver of an automobile, the driver may shift his feet in operating the controls without disturbing the lap tray or its retention on the lap of the driver.

The provision of the deep outer pockets and the shallower central well permits the tray to accommodate a great variety of beverage containers and to secure them so that spills are avoided and the beverage containers are readily retrieved from the appropriate supporting pocket or well. When not occupied by beverage containers, the outer pockets may conveniently support a cellular telephone giving easy access to the driver of an automobile. The shallow recesses 43 and 45 may serve the additional function of holding change to be used by a driver at toll booths on the tollways. The narrow and concave contour of the body portion of the tray of the present invention adapts the tray particularly well to use by the driver or passengers of an automobile. The symmetry of the tray about its lengthwise extending center line provides a design which is reversible so that the user may arrange a particular pocket on the left or right for greatest personal convenience.

The narrow width of the body portion of the tray and the concave configuration of the front and back edges in the disclosed embodiment are a consequence of the fact that the tray is designed primarily for use by the driver and passengers of an automobile where the compact shape is important and where the types of meals or snacks eaten in transit may be accommodated in a limited size tray. If the concepts of the present invention were applied to a tray designed specifically for consumption of buffet meals in the home, the width of the body portion of the tray would be increased. However, the spacing and the downward extending length of the projections 15 and 17 would remain substantially as described above.

As a further adaptation to accommodate the lap tray to a particular application, it is contemplated that pockets 25 and 33 could be eliminated and be replaced by simple downwardly extending projections that would comprise only the thigh engaging portions 60. In this manner, the overall length of the tray would be shortened to accommodate it for use by spectators at a sports stadium where bench type seats are closely spaced leaving little space for each individual spectator. As so modified, the tray 11 would be just slightly longer than the 14 inches between the leg engaging portions 60 of the projections 15 and 17. While this modification would reduce the capacity and the versatility of the tray 11, the shortened version would still have the functional advantages of the described preferred embodiment.

What is claimed as new and desired to be secured by Letters Patent of the United States is:

1. A lap tray for serving food and beverage items to a seated person with the tray positioned across the upper legs of the person comprising:

an elongated body portion having a length to span upper legs of said person while disposed horizontally, said elongated body portion having shallow food receiving recesses disposed along a lengthwise extending center line and terminating in first and second ends, a first projection carried by said body portion and extending downwardly at said first end, said first projection being formed with a first pocket opening upwardly and being of a size to receive the lower end of and thereby support a large beverage container, said first projection extending downwardly beyond the outermost portion of one of said person's upper legs with said tray centered in said person's lap, a second projection carried by said body portion and extending downwardly at said second end, said second projection being formed with a second pocket opening upwardly and being of a size to receive and support various types of food and beverage items, said second projection extending downwardly beyond the outermost portion of the other of said person's upper legs with said tray centered in said person's lap, said first and second projections each having substantially vertical wall portions which straddle the upper legs of said person to maintain said lap tray in a fixed position with respect to said person and in a generally horizontal position, said first pocket being generally cylindrical in configuration with inwardly tapering sidewalls to conform to the lower portion of a beverage container, said second pocket having an oval horizontal cross section to receive and support food and beverage items having non-cylindrical shapes, said pockets and said food receiving recesses and said body portion being symmetrical about said center line so that said lap tray may be laid crosswise in the lap of the person in either of two alternative positions to accommodate the convenience of said user.

2. A lap tray for serving food and beverage items to a seated person with the tray positioned across the upper legs of the person comprising:

an elongated body portion having a length to span upper legs of said person while disposed horizontally, said elongated body portion having shallow food receiving recesses disposed along a lengthwise extending center line and terminating in first and second ends, a first projection carried by said body portion and extending downwardly at said first end, said first projection being formed with a first pocket opening upwardly and being of a size to receive the lower end of and thereby support a large beverage container, said first projection extending downwardly beyond the outermost portion of one of said person's upper legs with said tray centered in said person's lap, a second projection carried by said body portion and extending downwardly at said second end, said second projection being formed with a second pocket opening upwardly and being of a size to receive and support various types of food and beverage items, said second projection extending downwardly beyond the outermost portion of the other of said person's upper legs with said tray centered in said person's lap, said first and second projections each having substantially vertical wall portions which straddle the upper legs of said person to maintain said lap tray in a fixed position with respect to said person and in a generally horizontal position, said body portion being formed with lengthwise extending edges which are concave to conform to the contour of the person's torso and to facilitate insertion into and removal of the tray with respect to the person's lap when lie is seated.

3. The lap tray of claim 2 wherein the distance between the first and second downwardly extending projections is on the order of 14 inches and the downward projection of said first and second downwardly extending projections is between 3 inches and 3 and ½ inches.

4. The lap tray of claim 3 wherein the width of said body portion at said first and second ends is on the order of 7 inches and the width midway between said first and second ends is on the order of five inches.

5. A tray of the type for use in serving food and beverage items when disposed horizontally across the thighs of a seated person comprising:

an elongated body portion having a length to span the upper legs of a seated person while disposed horizontally, said elongated body portion having shallow food receiving recesses disposed along a lengthwise extending center line and terminating in first and second ends, said body portion having side edges extending lengthwise between said ends, said side edges being symmetrical with respect to said center line, first and second projections carried by said body portion and extending downwardly at said first and second ends respectively, said first and second projections extending downwardly beyond the outermost portions of said person's thighs with said tray centered in said person's lap, said first and second projections each having substantially vertical wall portions which engage and straddle the thighs to maintain said lap tray in a fixed and generally horizontal position, said substantially vertical portions which engage and straddle the thighs being provided with roughened surfaces to prevent sliding in the engagement between said projections and the thighs.

6. A tray of the type for use in serving food and beverage items when disposed horizontally across the thighs of a seated person comprising:

an elongated body portion having a length to span the upper legs of a seated person while disposed horizontally, said elongated body portion having shallow food receiving recesses disposed along a lengthwise extending center line and terminating in first and second ends, said body portion having side edges extending lengthwise between said ends, said side edges being symmetrical with respect to said center line, first and second projections carried by said body portion and extending downwardly at said first and second ends respectively, said first and second projections extending downwardly beyond the outermost portions of said person's thighs with said tray centered in said person's lap, said first and second projections each having substantially vertical wall portions which engage and straddle the thighs to maintain said lap tray in a fixed and generally horizontal position, said first and second projections being formed with upwardly facing recesses which define first and second pockets respectively for receiving food and beverage items, said first and second pockets being of different size and shape to receive food and beverage items of various size, said tray being positionable for use in either of two alternative positions extending transverse to the person's legs with the location of the first and second pockets reversed to accommodate the convenience of the person using the tray, said side edges being curved inwardly from the ends of said body portion providing concave side edges to provide a narrowed central portion between said first and second ends to facilitate said tray's insertion onto and removal from the lap of a driver seated behind the steering wheel of a vehicle.

* * * * *